US009051098B2

(12) United States Patent
Abercrombie, III et al.

(10) Patent No.: US 9,051,098 B2
(45) Date of Patent: Jun. 9, 2015

(54) METHOD FOR PRESSURIZING CONTAINERS WITH NITROGEN

(75) Inventors: James Scott Abercrombie, III, Greenwich, CT (US); Nicholas Joseph Day, Henderson, NV (US); Darren L. Naud, Los Alamos, NM (US)

(73) Assignee: Inoflate, LLC, Greenwich, CT (US)

( * ) Notice: Subject to any disclaimer, the term of this patent is extended or adjusted under 35 U.S.C. 154(b) by 692 days.

(21) Appl. No.: 12/814,097

(22) Filed: Jun. 11, 2010

(65) Prior Publication Data

US 2011/0089058 A1 Apr. 21, 2011

Related U.S. Application Data

(60) Provisional application No. 61/252,736, filed on Oct. 19, 2009.

(51) Int. Cl.

| | |
|---|---|
| ***B65B 31/00*** | (2006.01) |
| ***B65D 51/28*** | (2006.01) |
| ***B65D 25/08*** | (2006.01) |
| ***B65D 81/20*** | (2006.01) |
| ***B65D 81/28*** | (2006.01) |

(52) U.S. Cl.

CPC ..... *B65D 51/28* (2013.01); *B65B 31/006* (2013.01); *B65D 81/2053* (2013.01); *B65D 81/2076* (2013.01); *B65D 81/28* (2013.01)

(58) Field of Classification Search

CPC ..... B65B 31/006; A23L 2/40; A23L 2/54; B65D 81/2053; B65D 81/2076; B65D 51/28; B65D 81/28

USPC ..... 53/440, 432, 401, 485, 420; 206/217, 206/219, 220, 221, 222; 215/373, 375, 215/DIG. 1, DIG. 8, 228; 264/530

See application file for complete search history.

(56) References Cited

U.S. PATENT DOCUMENTS

| | | | | |
|---|---|---|---|---|
| 2,073,273 | A | | 3/1937 | Korn et al. |
| 2,576,073 | A | * | 11/1951 | Kropa et al. ..... 220/DIG. 14 |
| 2,694,641 | A | * | 11/1954 | Atwood et al. ..... 206/219 |
| 2,472,363 | A | | 4/1956 | Hughes |

(Continued)

FOREIGN PATENT DOCUMENTS

| | | |
|---|---|---|
| DE | 4036421 | 5/1992 |
| EP | 0258057 | 3/1988 |

(Continued)

OTHER PUBLICATIONS

Diazonium Compound, Wikipedia.org/wiki/Diazonium_Compund, Dec. 15, 2010.

(Continued)

*Primary Examiner* — Stephen F Gerrity

(74) *Attorney, Agent, or Firm* — Ohlandt, Greeley, Ruggiero & Perle, LLP

(57) ABSTRACT

A container comprising a compartment and a closure, which hermetically seals the compartment. The closure comprises an active insert device that comprises one or more reactants that when initiated enter into a diazotization reaction produces nitrogen gas which is delivered to the compartment to increase the pressure of the compartment. The active insert device includes a filter that filters the gas and a vent port through which the gas is delivered to the compartment. A seal opens and closes the vent port based on a pressure difference between the compartment and the vent port side of the seal.

14 Claims, 15 Drawing Sheets

(56) References Cited

U.S. PATENT DOCUMENTS

| | | | | | |
|---|---|---|---|---|---|
| 2,895,270 | A | * | 7/1959 | Blaess | 53/432 |
| 3,053,422 | A | | 9/1962 | Tenison et al. | |
| 3,480,403 | A | | 11/1969 | Hovey | |
| 3,531,414 | A | * | 9/1970 | Randell et al. | 53/402 |
| 3,607,303 | A | | 9/1971 | Bingham | |
| 3,637,672 | A | * | 1/1972 | Seino et al. | 548/143 |
| 3,718,236 | A | | 2/1973 | Reyner et al. | |
| 3,881,621 | A | | 5/1975 | Adomaitis | |
| 3,888,998 | A | | 6/1975 | Sampson et al. | |
| 3,911,071 | A | | 10/1975 | Naumann | |
| 3,975,425 | A | * | 8/1976 | Wassen | 558/488 |
| 3,992,493 | A | | 11/1976 | Whyte et al. | |
| 4,007,134 | A | | 2/1977 | Liepa et al. | |
| 4,020,051 | A | * | 4/1977 | Herkes | 534/555 |
| 4,020,052 | A | * | 4/1977 | Detrick | 534/555 |
| 4,025,655 | A | | 5/1977 | Whyte et al. | |
| 4,035,455 | A | | 7/1977 | Rosenkranz et al. | |
| 4,110,255 | A | | 8/1978 | Liepa et al. | |
| 4,134,510 | A | | 1/1979 | Chang | |
| 4,177,239 | A | | 12/1979 | Gittner | |
| 4,186,215 | A | | 1/1980 | Buchel | |
| 4,214,011 | A | | 7/1980 | Strube | |
| 4,231,483 | A | | 11/1980 | Dechenne et al. | |
| 4,275,003 | A | * | 6/1981 | Ratton et al. | 534/579 |
| 4,316,409 | A | | 2/1982 | Adams et al. | |
| 4,342,398 | A | | 8/1982 | Chang | |
| 4,381,061 | A | | 4/1983 | Cerny et al. | |
| 4,458,584 | A | | 7/1984 | Annese et al. | |
| 4,465,199 | A | | 8/1984 | Aoki | |
| 4,466,342 | A | | 8/1984 | Basile et al. | |
| 4,496,517 | A | | 1/1985 | Kinoshita et al. | |
| 4,507,510 | A | * | 3/1985 | Yoshinaka et al. | 568/811 |
| 4,533,640 | A | * | 8/1985 | Shafer | 206/219 |
| 4,613,330 | A | | 9/1986 | Michelson | |
| 4,642,968 | A | | 2/1987 | McHenry et al. | |
| 4,662,154 | A | | 5/1987 | Hayward | |
| 4,667,454 | A | | 5/1987 | McHenry et al. | |
| 4,723,670 | A | | 2/1988 | Robinson et al. | |
| 4,826,695 | A | | 5/1989 | Tanner | |
| 4,969,563 | A | | 11/1990 | Strassheimer | |
| 4,979,673 | A | | 12/1990 | Wilk | |
| 5,033,254 | A | | 7/1991 | Zenger | |
| 5,234,126 | A | | 8/1993 | Jonas et al. | |
| 5,251,424 | A | | 10/1993 | Zenger et al. | |
| 5,255,812 | A | | 10/1993 | Hsu | |
| 5,269,437 | A | | 12/1993 | Gygax | |
| 5,270,069 | A | | 12/1993 | Plester | |
| 5,383,324 | A | | 1/1995 | Segers et al. | |
| 5,389,332 | A | | 2/1995 | Amari et al. | |
| 5,549,037 | A | | 8/1996 | Stumphauzer | |
| 5,588,556 | A | | 12/1996 | Sancoff et al. | |
| 5,624,645 | A | | 4/1997 | Malley | |
| 5,705,211 | A | | 1/1998 | Bedell et al. | |
| 5,763,030 | A | | 6/1998 | Matsui | |
| 5,874,547 | A | * | 2/1999 | Larsen et al. | 534/565 |
| 5,884,792 | A | | 3/1999 | Krishnakumar et al. | |
| 6,039,820 | A | * | 3/2000 | Hinshaw et al. | 149/45 |
| 6,176,382 | B1 | | 1/2001 | Bazlur Rashid | |
| 6,244,022 | B1 | | 6/2001 | Cornell et al. | |
| 6,299,007 | B1 | | 10/2001 | Takeuchi | |
| 6,390,292 | B2 | | 5/2002 | Hawthorne | |
| 6,412,526 | B2 | | 7/2002 | Castillo | |
| 6,541,055 | B1 | | 4/2003 | Luzenberg | |
| 6,926,138 | B1 | | 8/2005 | Basham et al. | |
| 7,159,374 | B2 | | 1/2007 | Abercrombie et al. | |
| 7,637,082 | B2 | | 12/2009 | Abercrombie, III et al. | |
| 2002/0179461 | A1 | | 12/2002 | Mollstam et al. | |
| 2003/0017236 | A1 | | 1/2003 | Makita et al. | |
| 2003/0116522 | A1 | | 6/2003 | Julian et al. | |
| 2004/0026270 | A1 | | 2/2004 | Liang | |
| 2005/0155325 | A1 | | 7/2005 | Abercrombie, III et al. | |
| 2007/0090000 | A1 | | 4/2007 | Hjalmarsson | |
| 2008/0149585 | A1 | | 6/2008 | Valentine | |
| 2009/0209715 | A1 | | 8/2009 | Ohuchi et al. | |

FOREIGN PATENT DOCUMENTS

| | | |
|---|---|---|
| EP | 0314 554 | 5/1989 |
| FR | 2 630 090 | 10/1989 |
| GB | 2076628 | 12/1980 |
| WO | WO/99/44901 | 9/1999 |

OTHER PUBLICATIONS

Supplemental European Search Report May 15, 2009 for corresponding Euroepan Patent Application No. 04 81 0762.

Diazonium Compound, Wikipedia.org/wiki/Diazonium_Compound, Dec. 15, 2009.

International Search Report for corresponding to International Patent Application No. PCT/US2010/051728 dated Dec. 3, 2010.

* cited by examiner

METHOD FOR PRESSURIZING CONTAINERS WITH NITROGEN

RELATED APPLICATION

This application claims the benefit of U.S. Provisional Application, Ser. No. 61/252,736, filed on Oct. 19, 2009, the entire contents of which are incorporated herein.

FIELD OF THE DISCLOSURE

This disclosure relates to a container comprising a compartment and a closure, which hermetically seals the compartment. The closure comprises an active insert device, which when excited by an external energy source delivers a gas to the compartment to increase the pressure of the compartment.

BACKGROUND OF THE DISCLOSURE

To prevent microbial spoilage, a hot fill process is often used to package many food and beverage products at high temperatures to sterilize both the product and container. When the liquid content of the container cools, it contracts and either creates an internal vacuum or causes the container to deform, as by shrinking, buckling or paneling. Currently, plastic bottles are designed with panels, ribs and additional resin to compensate for the contraction and prevent bottle deformation. When the smooth side wall of the bottle is replaced with these panels, flexible packaging shapes and designs are prevented, thereby making label application difficult.

Known approaches to the bottle deformation problem add a gas, such as carbon dioxide or nitrogen, to the bottle after sealing. U.S. Pat. No. 7,159,374 discloses an active insert device that contains a reactant and that is affixed to the bottle cap. After sealing the reactant is initiated to a reaction that produces the gas, which is delivered to a headspace of the bottle. The active insert device includes a membrane that admits moisture from the bottle contents into the active insert device to initiate the reaction. The resulting gas then passes through the membrane into the headspace of the bottle. There is a risk that the membrane will loosen and fall into the bottle and contaminate the bottle contents.

Thus, there is a need for a method that releases gas in a closed container to retain microbial stability without leaving a residue or a device that must be removed at time of consumption.

There is also a need to eliminate buckling or paneling in closed hot filled containers in order to capture decorative, lightweight and flexibility benefits.

There is also a need to sufficiently pressurize a closed hot filled container in order to capture structural benefits without deforming the container.

There is a further need to release ingredients and functional components to closed containers on a time delayed basis to enhance functionality.

There is still another need for a container in which gas can be released to pressurize the container after the container is sealed.

There is yet another need for a closure or cap for a container that can release gas into the container after sealing to pressurize the container.

There is yet a further need to substantially eliminate any residue from the active insert device from entering the compartment.

SUMMARY OF THE DISCLOSURE

In one embodiment the container of the present disclosure comprises a compartment and a closure that hermetically seals the compartment. An active insert device is disposed in the compartment and comprises one or more reactants that when initiated enter into a diazotization reaction to produce and deliver a gas to the compartment, thereby increasing a pressure of the compartment.

In another embodiment of the container of the present disclosure, a first one of the reactants comprises a primary amine selected from the group of R—$NH_2$, where R is selected from the group consisting of: normal alkyl amines, aromatic amines, amides, and salts of sulfamates.

In another embodiment of the container of the present disclosure, the primary amine is selected from the group consisting of: sodium sulfamate, n-propyl amine, anilene, propylamide, and o-propyl sulfamate.

In another embodiment of the container of the present disclosure, a second of the reactants comprises a proton donor and either a nitrite salt or a nitrite ester.

In another embodiment of the container of the present disclosure, the nitrite salt is selected from the group of the salts of nitrous acid, consisting of: lithium nitrite, sodium nitrite, potassium nitrite, calcium nitrite, and barium nitrite, and wherein the nitrite ester is selected from a group consisting of: nitrite esters of alcohols.

In another embodiment of the container of the present disclosure, the proton donor is any organic acid or any non-organic acid.

In another embodiment of the container of the present disclosure, the organic acid is selected from the group consisting of: mono and dihydrogen citrates, citric, ascorbic, carboxylic and phenolic acids, and wherein the non-organic acid is selected from the group consisting of: hydrochloric, sulfuric and bisulfate.

In another embodiment of the container of the present disclosure, the diazotization reaction is initiated in response to energy provided by an external energy source.

In another embodiment of the container of the present disclosure, the energy creates contact between the reactants and initiates the diazotization reaction.

In another embodiment of the container of the present disclosure, the active insert device further comprises a plurality of layers, wherein the reactant is disposed between first and second layers of the plurality of layers.

In another embodiment of the container of the present disclosure, the active insert device further comprises a filter that filters the gas before delivery to the compartment.

In another embodiment of the container of the present disclosure, the gas is nitrogen. The filter comprises a filter material that retains reaction products of the reaction while allowing the nitrogen gas to be delivered to the compartment.

In another embodiment of the container of the present disclosure, the filter material contains a mixture of permanganate, hydroxide and activated carbon that allows nitrogen gas to be delivered to the compartment while retaining any carbon dioxide, oxides of nitrogen, formaldehyde, acid gases, amines, chlorine, cyanide, nitrates, nitrites and hydrocarbons of the reaction.

In another embodiment of the container of the present disclosure, the filter further comprises the first layer and a third layer of the plurality of the layers. The filter material is disposed between the first and third layer. Each of the first and third layers provides a controlled porosity layer that allows the nitrogen gas to pass through while retaining other products of the reaction.

In another embodiment of the container of the present disclosure, the plurality of layers is disposed on an interior surface of the closure either by bonding or by a retaining element.

In another embodiment of the container of the present disclosure, at least one vent port is disposed in a perimeter portion of at least one of the plurality of layers in fluid communication with the filtered gas.

In another embodiment of the container of the present disclosure, a vent seal that is sealed to the perimeter portion of the plurality of layers to cover the vent port. The vent seal comprises a material of elasticity that under pressure of the filtered gas moves the vent seal away from the at least one layer thereby opening the vent port so that the filtered gas flows into the compartment. Upon equalization of pressure between the active insert device and the compartment, the vent seal flexes back to cover the vent port, thereby preventing any back flow to the active insert device.

In another embodiment of the container of the present disclosure, the vent port is one of a plurality of vent ports disposed in the perimeter portion, and wherein the vent ports are in fluid communication with the filtered gas via a space between the active insert device and the internal surface of the closure.

In another embodiment of the container of the present disclosure, the active insert device further comprises a sealing insert. The plurality of layers is disposed in an interior of the sealing insert.

In another embodiment of the container of the present disclosure, the sealing insert forms a hermetic seal with either or both of an internal surface or a top surface of a neck finish of the container.

In another embodiment of the container of the present disclosure, the active insert device comprises a backing that is hermetically sealed to a lip of the sealing insert such that the interior is hermetically sealed.

In another embodiment of the container of the present disclosure, the sealing insert comprises a bottom with one or more vent ports in fluid communication with the gas.

In another embodiment of the container of the present disclosure, the active insert device further comprises a septum seal with one or more vent ports that are disposed either above or below the bottom.

In another embodiment of the container of the present disclosure, the reactant is a first reactant. A second reactant is also disposed between the first and second layers. A third layer of the plurality of layers is disposed between the first and second reactants. The third layer is modified in response to energy provided by the external energy source to expose the first and second reactants to one another and thereby initiate the reaction.

In an embodiment of the method of the present disclosure, a gas is delivered to a container that includes a closure and a compartment. The method comprises:

disposing an active insert device into the compartment, wherein the active insert device comprises one or more reactants;

initiating the reactants into a diazotization reaction to produce a gas; and delivering the gas to the compartment, thereby increasing a pressure of the compartment.

In another embodiment of the method of the present disclosure, a first one of the reactants comprises a primary amine selected from the group of R—$NH_2$, where R is selected from the group consisting of: normal alkyl amines, aromatic amines, amides, and salts of sulfamates.

In another embodiment of the method of the present disclosure, the primary amine is selected from the group consisting of: sodium sulfamate, n-propyl amine, anilene, propylamide, and o-propyl sulfamate.

In another embodiment of the method of the present disclosure, a second of the reactants comprises a proton donor and either a nitrite salt or a nitrite ester.

In another embodiment of the method of the present disclosure, the nitrite salt is selected from the group of the salts of nitrous acid, consisting of: lithium nitrite, sodium nitrite, potassium nitrite, calcium nitrite, and barium nitrite, and wherein the nitrite ester is selected from a group consisting of: nitrite esters of alcohols.

In another embodiment of the method of the present disclosure, the proton donor is any organic acid or any non-organic acid.

In another embodiment of the method of the present disclosure, the organic acid is selected from the group consisting of: mono and dihydrogen citrates, citric, ascorbic, carboxylic and phenolic acids. The non-organic acid is selected from the group consisting of: hydrochloric, sulfuric and bisulfate.

In another embodiment of the method of the present disclosure, the diazotization reaction is initiated in response to energy provided by an external energy source.

In another embodiment of the method of the present disclosure, the energy creates contact between the reactants and initiates the diazotization reaction.

In another embodiment of the method of the present disclosure, the active insert device further comprises a heat producing element in thermal transfer relationship to the reactant. The source of energy provides electromagnetic energy that induces an electrical current in the heat producing element so as to thermally initiate the diazotization reaction.

In another embodiment of the method of the present disclosure, the active insert device is disposed on the closure. The disposing step comprises fastening the closure to the container.

In another embodiment of the method of the present disclosure, the method further comprises filtering the gas before delivery to the compartment.

In another embodiment of the method of the present disclosure, the gas is nitrogen. The filtering step uses a filter material that retains reaction products of the reaction while allowing the nitrogen gas to be delivered to the compartment.

In another embodiment of the method of the present disclosure, the filter material contains a mixture of permanganate, hydroxide and activated carbon that allows nitrogen gas to be delivered to the compartment while retaining any carbon dioxide, oxides of nitrogen, formaldehyde, acid gases, amines, chlorine, cyanide, nitrates, nitrites and hydrocarbons of the reaction.

In another embodiment of the method of the present disclosure, the gas is delivered to the compartment via at least one vent port. The vent port is closed when a pressure on the active insert device side of the vent port equalizes with a pressure of the compartment so as to prevent back flow.

In an embodiment of the closure of the present disclosure, the closure is for a container having a neck finish and a compartment. The closure comprises a cylinder that is styled for fitting on the neck finish. The cylinder comprises a top having an internal surface. An active insert device, which is disposed in the cylinder, comprises one or more reactants that when initiated enter into a diazotization reaction to produce and deliver a gas to the compartment.

In another embodiment of the closure of the present disclosure, a first one of the reactants comprises a primary amine selected from the group of R—$NH_2$, where R is selected from the group consisting of: normal alkyl amines, aromatic amines, amides, and salts of sulfamates.

In another embodiment of the closure of the present disclosure, the primary amine is selected from the group consisting of: sodium sulfamate, n-propyl amine, anilene, propylamide, and o-propyl sulfamate.

In another embodiment of the closure of the present disclosure, a second of the reactants comprises a proton donor and either a nitrite salt or a nitrite ester.

In another embodiment of the closure of the present disclosure, the nitrite salt is selected from the group of the salts of nitrous acid, consisting of: lithium nitrite, sodium nitrite, potassium nitrite, calcium nitrite, and barium nitrite, and wherein the nitrite ester is selected from a group consisting of: nitrite esters of alcohols.

In another embodiment of the closure of the present disclosure, the proton donor is any organic acid or any non-organic acid.

In another embodiment of the closure of the present disclosure, the organic acid is selected from the group consisting of: mono and dihydrogen citrates, citric, ascorbic, carboxylic and phenolic acids. The non-organic acid is selected from the group consisting of: hydrochloric, sulfuric and bisulfate.

In another embodiment of the closure of the present disclosure, the diazotization reaction is initiated in response to energy provided by an external energy source.

In another embodiment of the closure of the present disclosure, the energy creates contact between the reactants and initiates the diazotization reaction.

In another embodiment of the closure of the present disclosure, the active insert device further comprises a plurality of layers. The reactant is disposed between first and second layers of the plurality of layers.

In another embodiment of the closure of the present disclosure, the active insert device further comprises a filter that filters the gas before delivery to the compartment.

In another embodiment of the closure of the present disclosure, the gas is nitrogen. The filter comprises a filter material that retains reaction products of the reaction while allowing the nitrogen gas to be delivered to the compartment.

In another embodiment of the closure of the present disclosure, the filter material contains a mixture of permanganate, hydroxide and activated carbon that allows nitrogen gas to be delivered to the compartment while retaining any carbon dioxide, oxides of nitrogen, formaldehyde, acid gases, amines, chlorine, cyanide, nitrates, nitrites and hydrocarbons of the reaction.

In another embodiment of the closure of the present disclosure, the filter further comprises the first layer and a third layer of the plurality of the layers. The filter material is disposed between the first and third layer. Each of the first and third layers provide a controlled porosity layer that allows the nitrogen gas to pass through while retaining other products of the reaction.

In another embodiment of the closure of the present disclosure, the plurality of layers is disposed on the internal surface either by bonding or by a retaining element.

In another embodiment of the closure of the present disclosure, at least one vent port is disposed in a perimeter portion of at least one of the plurality of layers in fluid communication with the filtered gas.

In another embodiment of the closure of the present disclosure, a vent seal is sealed to the perimeter portion of the plurality of layers to cover the vent port. The vent seal comprises a material of elasticity that under pressure of the filtered gas moves the vent seal away from the at least one layer thereby opening the vent port so that the filtered gas flows into the compartment. Upon equalization of pressure between the active insert device and the compartment, the vent seal flexes back to cover the vent port, thereby preventing any back flow to the active insert device.

In another embodiment of the closure of the present disclosure, the vent port is one of a plurality of vent ports disposed in the perimeter portion. The vent ports are in fluid communication with the filtered gas via a space between the active insert device and the internal surface of the closure.

In another embodiment of the closure of the present disclosure, the active insert device further comprises a sealing insert. The plurality of layers is disposed in an interior of the sealing insert.

In another embodiment of the closure of the present disclosure, the sealing insert forms a hermetic seal with either or both of the internal surface of the cylinder or a top surface of a neck finish of the container.

In another embodiment of the closure of the present disclosure, the active insert device comprises a backing that is hermetically sealed to a lip of the sealing insert such that the interior is hermetically sealed.

In another embodiment of the closure of the present disclosure, the sealing insert comprises a bottom with one or more vent ports in fluid communication with the gas.

In another embodiment of the closure of the present disclosure, the active insert device further comprises a septum seal with one or more vent ports that is disposed either above or below the bottom.

In another embodiment of the closure of the present disclosure, the reactant is a first reactant. The active device further comprises a second reactant that is also disposed between the first and second layers. A third layer of the plurality of layers is disposed between the first and second reactants. The third layer is modified in response to energy provided by the external energy source to expose the first and second reactants to one another and thereby initiate the reaction.

BRIEF DESCRIPTION OF THE DRAWINGS

Other and further objects, advantages and features of the present disclosure will be understood by reference to the following specification in conjunction with the accompanying drawings, in which like reference characters denote like elements of structure and.

DESCRIPTION OF THE PREFERRED EMBODIMENTS

Figure 1:
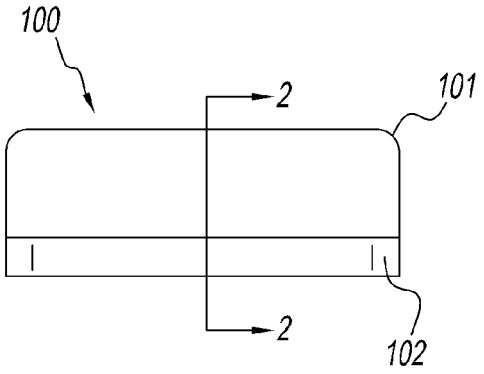
FIG. 1 is a side view of a closure of a device embodying the present disclosure.
Figure 2:
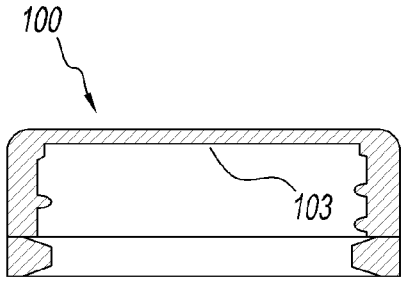
FIG. 2 is a cross-sectional view along line 2 of FIG. 1.
Figure 3:
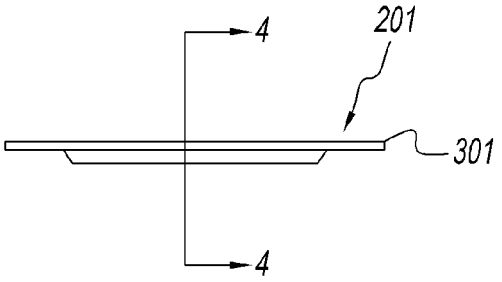
FIG. 3 is a side view of an active insert device of the device of the present disclosure.

Referring to FIGS. 1-3, a first embodiment of the present disclosure is shown. A closure 100 comprises a cap 101, a pilfer band 102 and an active insert device 201. Cap 101 is designed to accept and retain active insert device 201 that is bonded along the internal perimeter of an internal surface 103 of cap 101.

Figure 4:
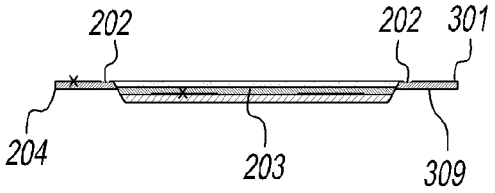
FIG. 4 is a cross-sectional view along line 4 of FIG. 3.
Figure 5:
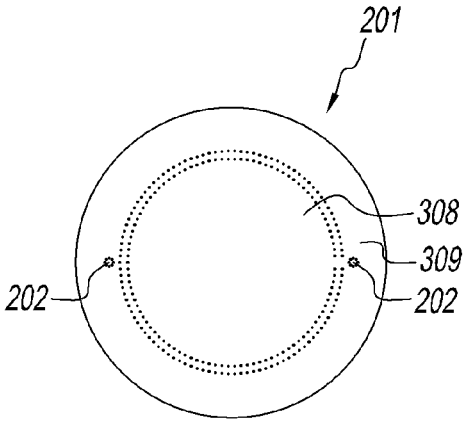
FIG. 5 is a top view of the insert device of FIG. 3.

Referring to FIGS. 3-5, active insert device 201 comprises a shroud 308, a vent seal 309, a backing membrane 301 and internal components 203. Backing membrane 301, shroud 308 and some of the internal components 203 are bonded together along the circumference of shroud 308 with a suitable bond 204 that provides a complete hermetic seal along the circumference of active insert device 201. Active insert device 201 also has one or more vent ports 202 that are cut through bond 204 prior to vent seal 309 being bonded to an external face of shroud 308.

Figure 6:
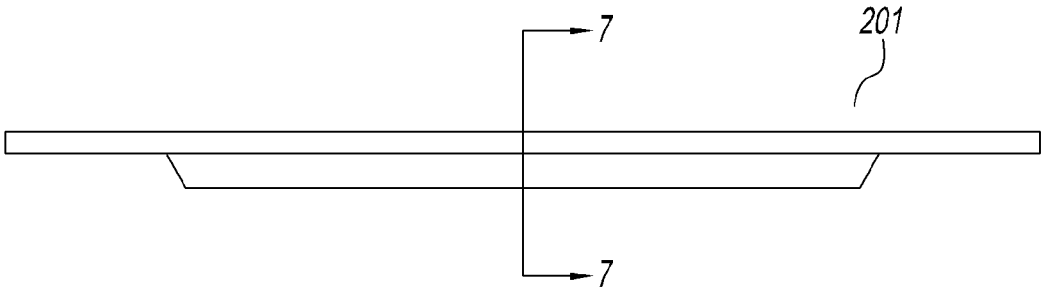
FIG. 6 is an enlarged side view of the active insert device of FIG. 3.
Figure 7:
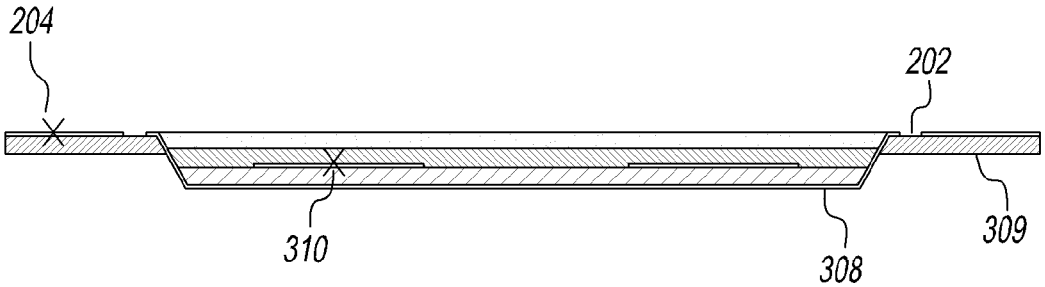
FIG. 7 is a cross-sectional view along line 7 of FIG. 6.
Figure 8:
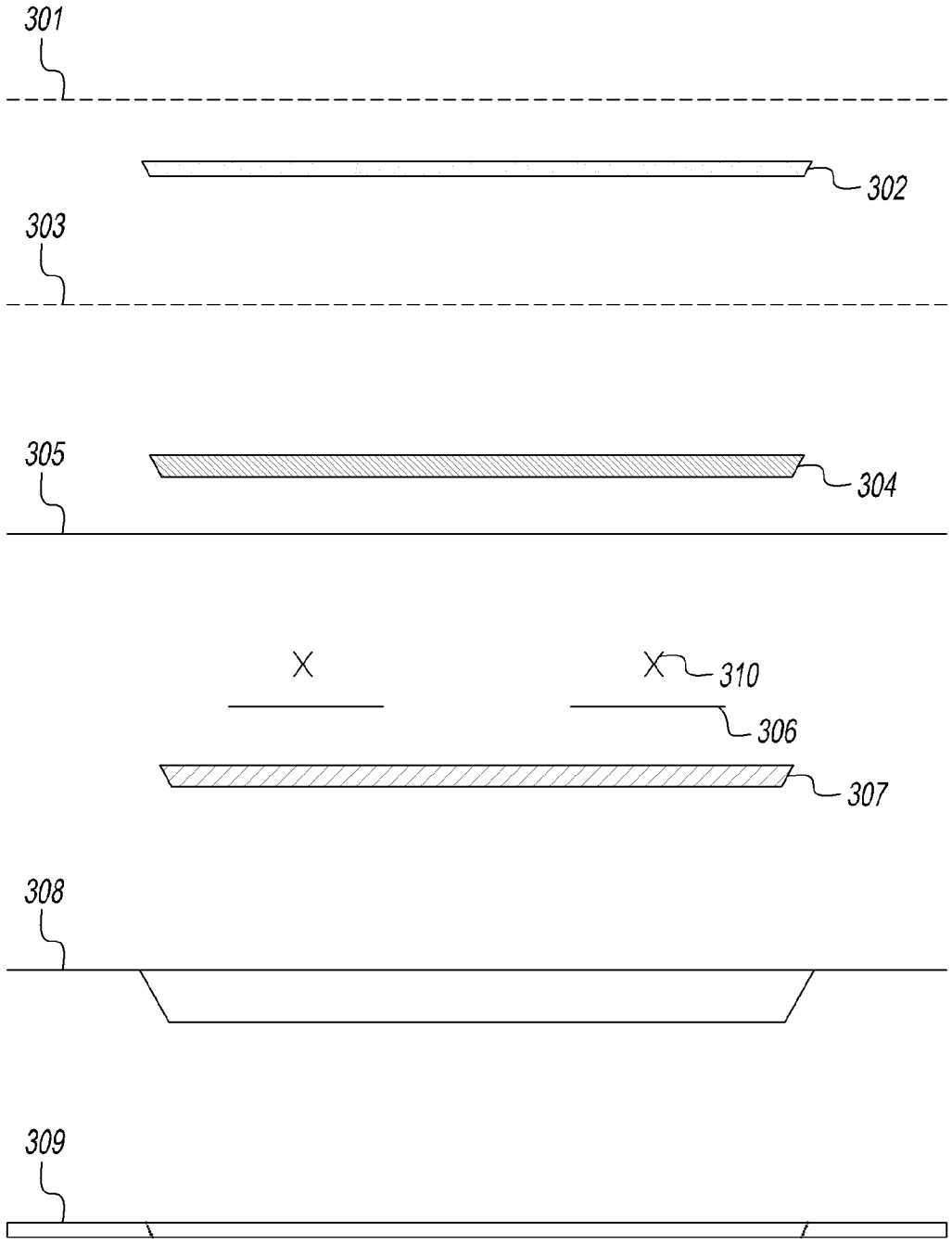
FIG. 8 is an exploded view of FIG. 7.

Referring to FIGS. 6-8, active insert device 201 comprises a first reactant 307, a metallic inductor 306, a separator seal 305, a second reactant 304, a filter membrane 303 and a filter media 302. Prior to assembly, separator seal 305 and metallic inductor 306 are bonded together through a suitable bond 310. Upon assembly, shroud 308, separator seal 305, filter membrane 303 and a backing membrane 301 are all laminated together through bond 204 to form a laminated assembly in which first reactant 307 is between separator seal 305 and shroud 308, second reactant 304 is between separator seal 305 and filter membrane 303, and filter media 302 is between filter membrane 303 and backing member 301. Upon completion of bond 204, one or more vent ports 202 are cut through the laminated assembly of components at bond 204. Vent seal 309 is then bonded to the external face of shroud 308.

Figure 9:
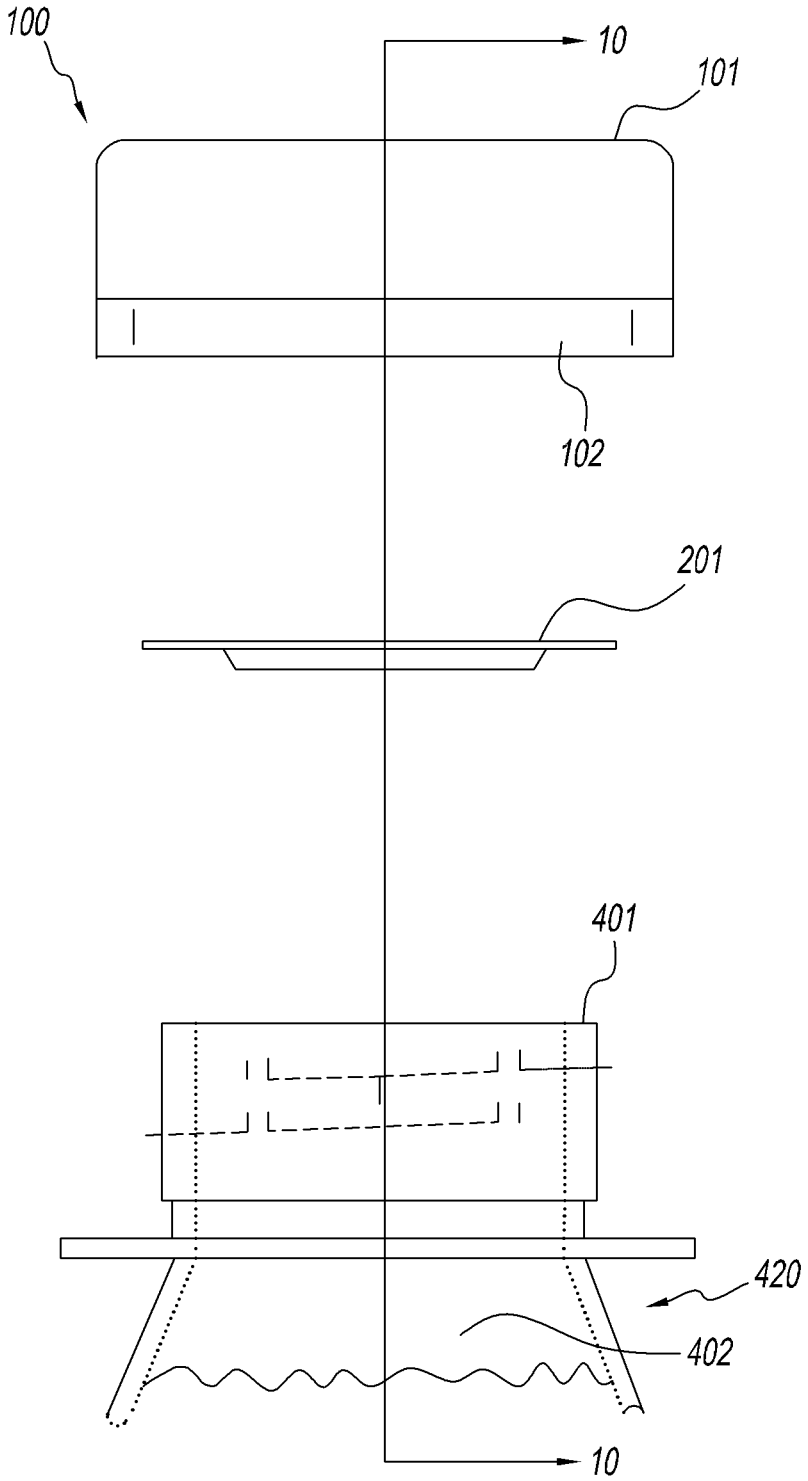
FIG. 9 is an exploded side view of a device of the present disclosure with the active insert device of FIG. 3 positioned in the closure of FIG. 1.
Figure 10:
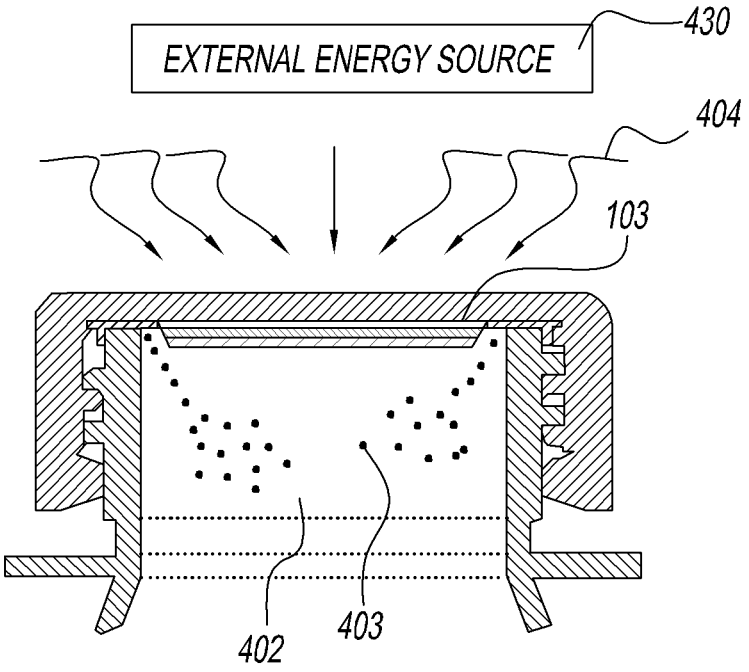
FIG. 10 is a cross-sectional view of FIG. 9 along line 10.

Referring to FIGS. 9 and 10, functional closure 100 is mounted onto a container neck finish 401 of a container 420. Functional closure 100 serves two functions. First, functional closure 100 provides a hermetic seal to neck finish 401. Second, functional closure 100 provides a housing for active insert device 201, which can be initiated actively in order to provide gas 403 to container 420 or a headspace 402 while still maintaining the integrity of the hermetic seal on neck finish 401.

Figure 11:
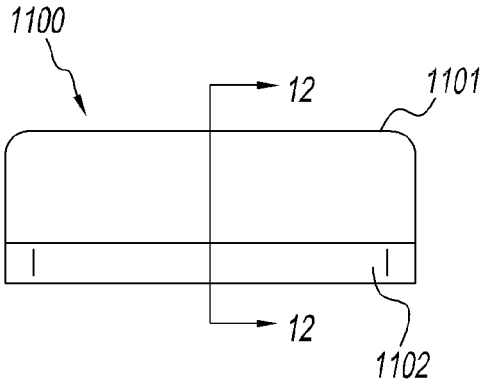
FIG. 11 is a side view of a second embodiment of a closure of a device embodying the present disclosure.
Figure 12:
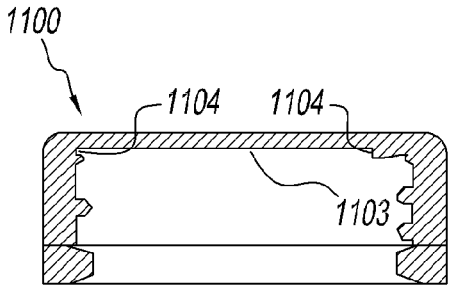
FIG. 12 is a cross-sectional view along line 12 of FIG. 11.
Figure 13:
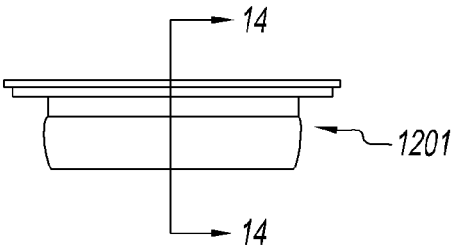
FIG. 13 is a side view of a second embodiment of an active insert device of the device of the present disclosure.

Referring to FIGS. 11-13, a second embodiment of the present disclosure is shown. A closure 1100 comprises a cap 1101, a pilfer band 1102 and an active insert device 1201. Cap 1101 is designed to accept and retain active insert device 1201 that is either bonded along the internal perimeter of the internal surface 1103 of cap 1101, or is permanently retained behind a recess 1104 that acts as a locking clip around the external ring surface of active insert device 1201.

Figure 14:
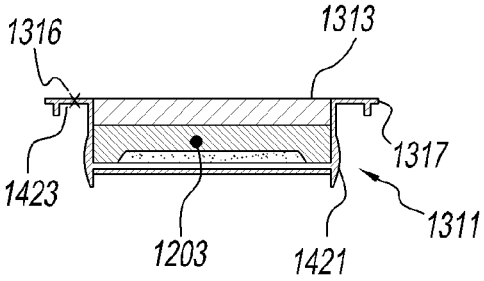
FIG. 14 is a cross-sectional view along line 14 of FIG. 13.
Figure 15:
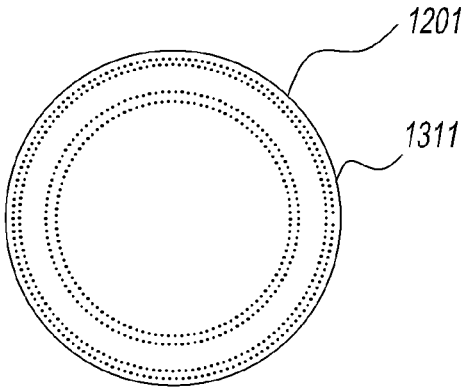
FIG. 15 is a top view of the insert device of FIG. 13.

Referring to FIGS. 13-15, active insert device 1201 comprises a sealing insert 1311, a backing 1313 and internal components 1203. Backing 1313, sealing insert 1311 and some of the internal components 1203 are bonded together along the top lip 1317 of sealing insert 1311 with a hermetically sealed bond 1316 that provides a complete hermetic seal along the circumference of active insert device 1201.

Figure 16:
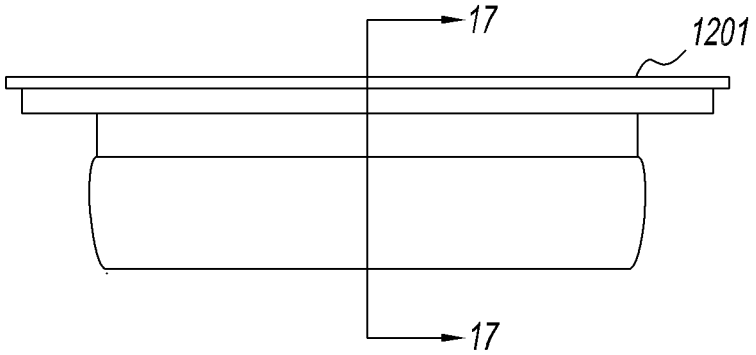
FIG. 16 is an enlarged side view of the active insert device of FIG. 13.
Figure 17:
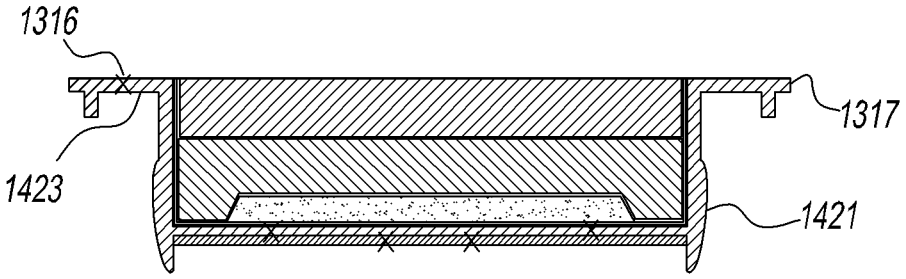
FIG. 17 is a cross-sectional view along line 17 of FIG. 16.
Figure 18:
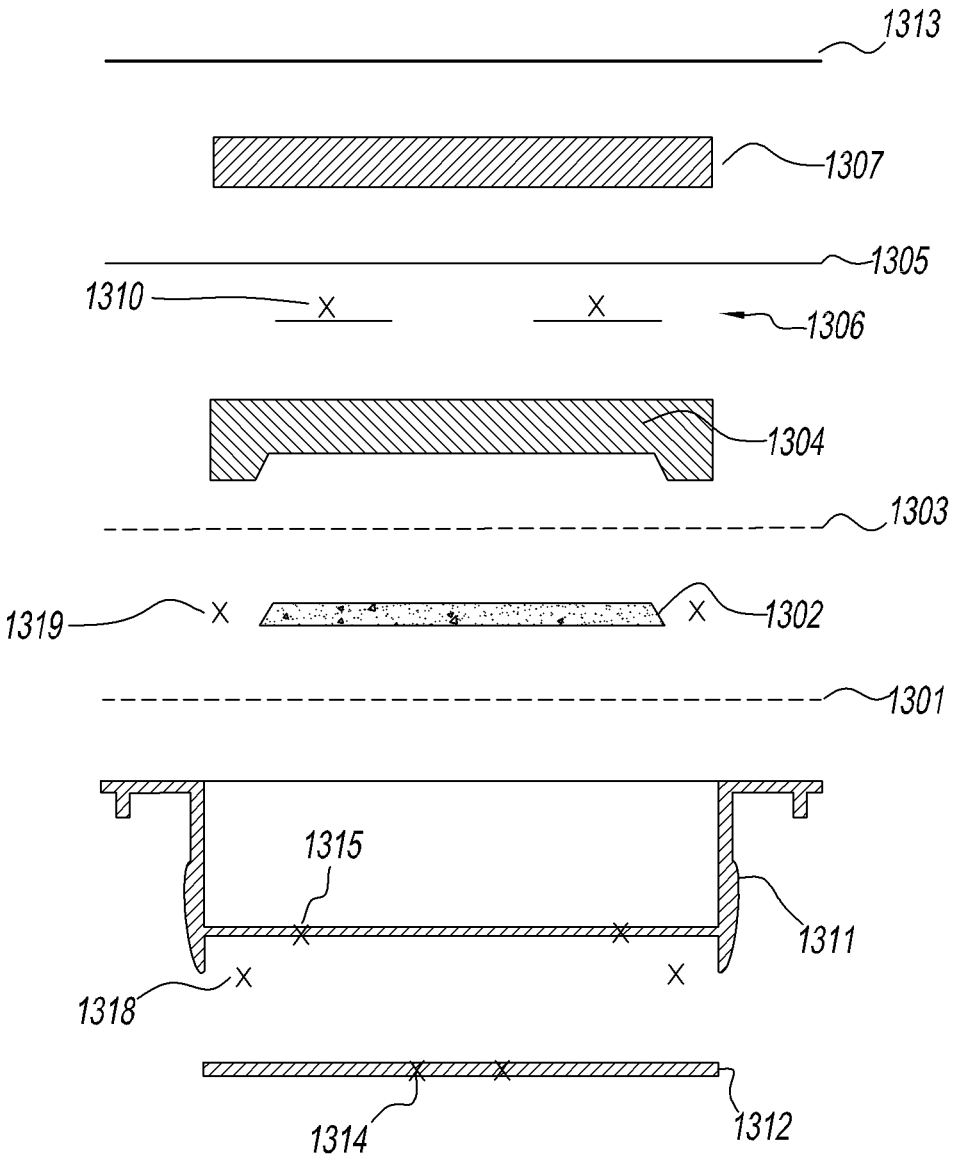
FIG. 18 is an exploded view of FIG. 17.

Referring to FIGS. 16-18, active insert device 1201 comprises backing 1313, a first reactant 1307, a metallic inductor 1306, a separator seal 1305, a second reactant 1304, a filter membrane 1303, a filter media 1302, a backing membrane 1301, a septum seal 1312 with score marks 1314 and sealing insert 1311 with perforations 1315. Prior to assembly, separator seal 1305 and metallic inductor 1306 are bonded together through a suitable bond 1310, and septum seal 1312 is bonded to the underside of sealing insert 1311 through a suitable bond 1318. Filter media 1302 is sandwiched between filter membrane 1303 and backing membrane 1301, which are bonded to one another with a suitable bond 1319. Upon assembly, backing 1313, first reactant 1307, separator seal 1305 with metallic inductor 1306, second reactant 1304, filter membrane 1303 with filter media 1302 and backing membrane 1301, are inserted into sealing insert 1311 and secured by a hermetically sealed bond 1316 across the top lip 1317 of sealing insert 1311, thereby combining backing 1313, separator seal 1305 and membranes 1301 and 1303 and sealing insert 1311 into a single unit.

Figure 19:
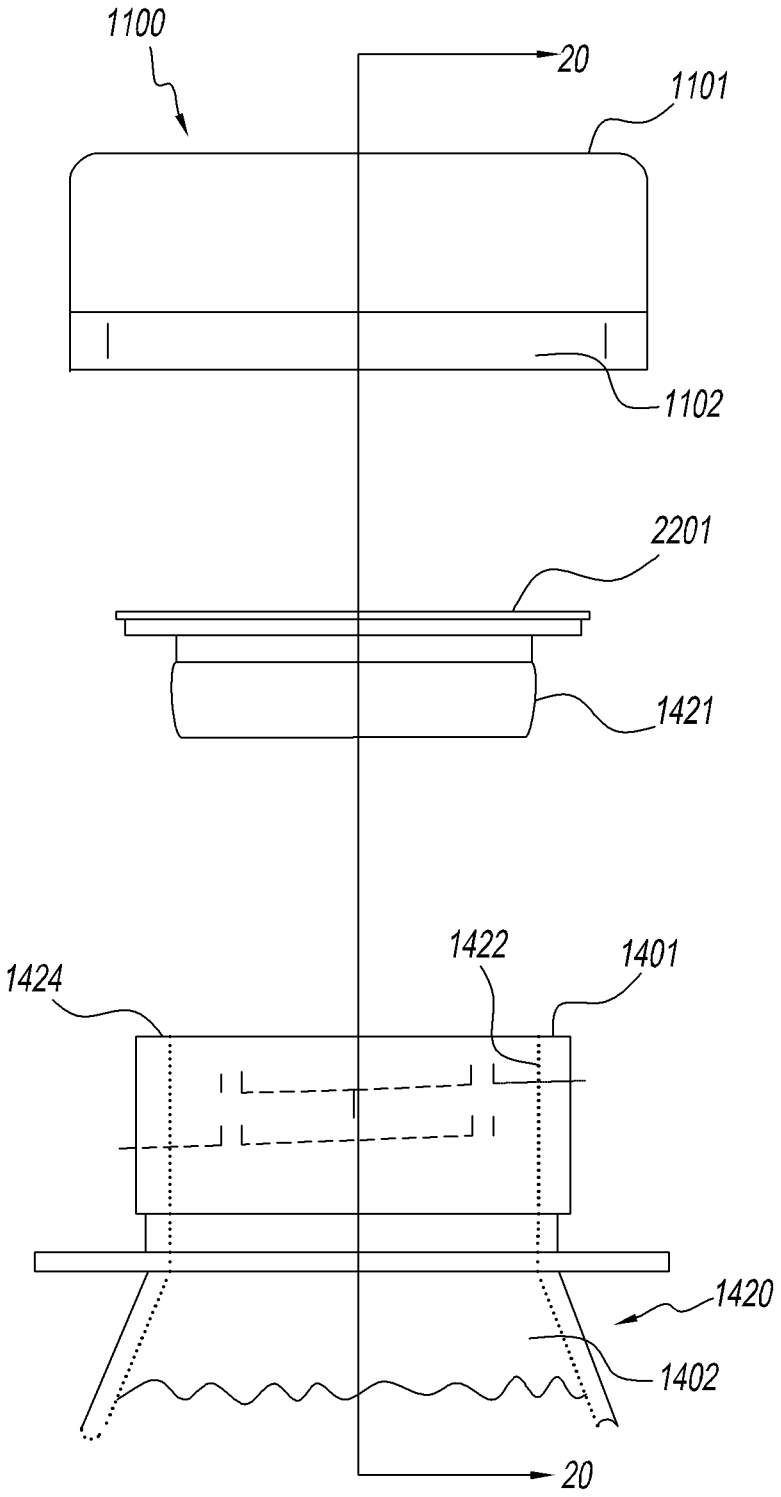
FIG. 19 is an exploded side view of a second embodiment of a device of the present disclosure with the active insert device of FIG. 13 positioned in the closure of FIG. 11.
Figure 20:
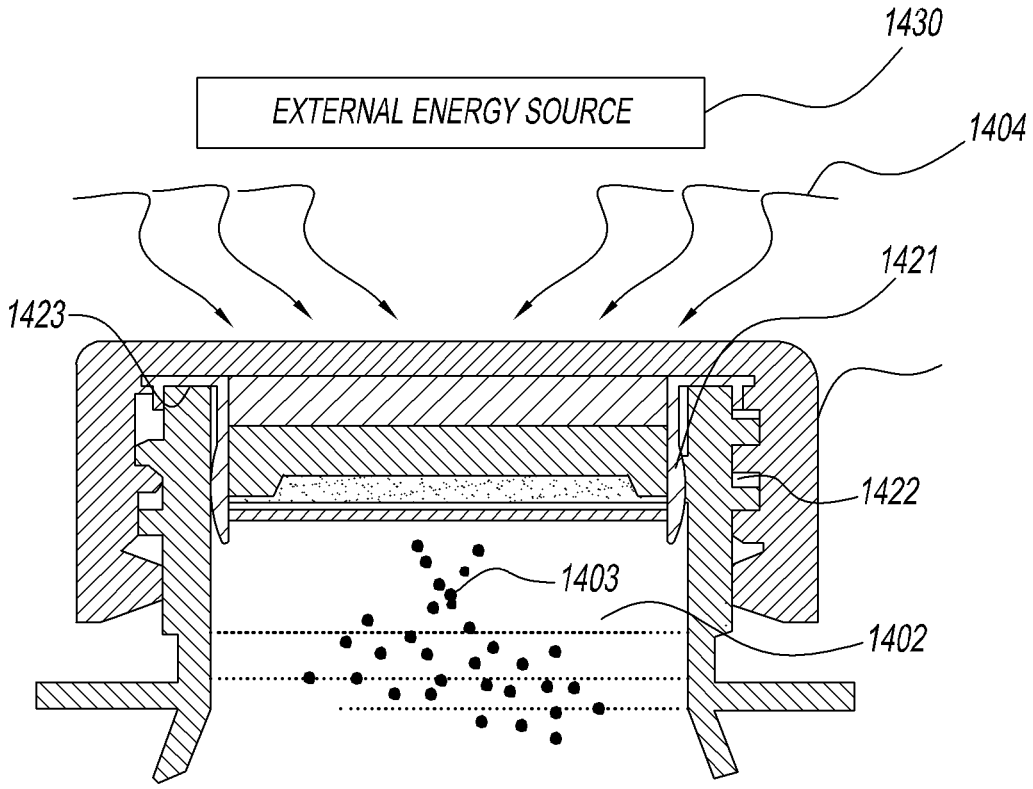
FIG. 20 is a cross-sectional view of FIG. 19 along line 20.

Referring to FIGS. 19 and 20, functional closure 1100 is mounted onto a container neck finish 1401 of a container 1420. Functional closure 1100 serves two functions. First, functional closure 1100 provides a hermetic seal to neck finish 1401 achieved through an internal lip 1421 of sealing insert 1311 contacting an internal surface 1422 of neck finish 1401 and through a landing surface 1423 (FIG. 17) contacting a landing 1424 of neck finish 1401. Second, functional closure 1100 provides a housing for active insert device 1201, which can be initiated actively in order to provide gas 1403 to container 1420 or a headspace 1402 while still maintaining the integrity of the hermetic seal on neck finish 1401.

Figure 21:
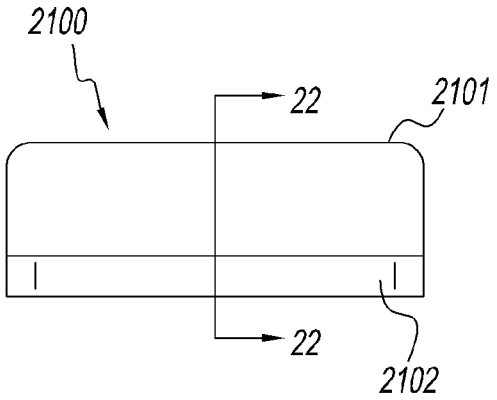
FIG. 21 is a side view of a third embodiment of a closure of a device embodying the present disclosure.
Figure 22:
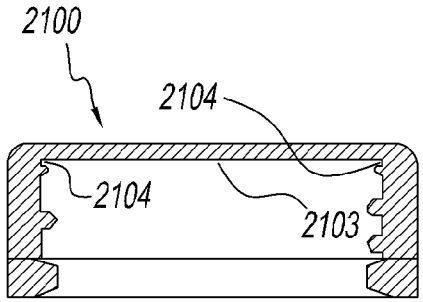
FIG. 22 is a cross-sectional view along line 22 of FIG. 21.
Figure 23:
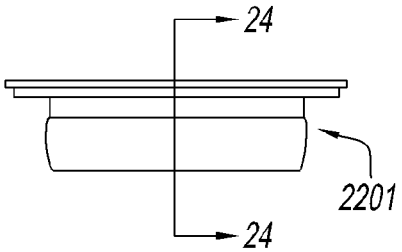
FIG. 23 is a side view of a third embodiment of an active insert device of the device of the present disclosure.

Referring to FIGS. 21-23, a third embodiment of the present disclosure is shown. A closure 2100 comprises a cap 2101, a pilfer band 2102 and an active insert device 2201. Cap 2101 is designed to accept and retain active insert device 2201 that is either bonded along the internal perimeter of an internal surface 2103 of cap 2101, or is permanently retained behind a recess 2104 that acts as a locking clip around the external ring surface of active insert device 2201.

Figure 24:
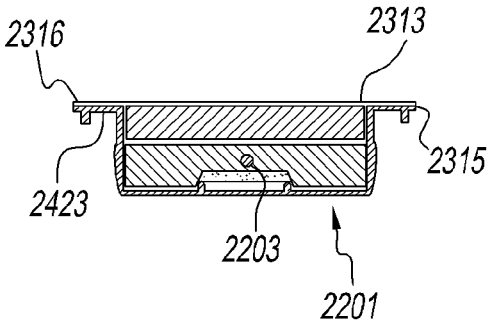
FIG. 24 is a cross-sectional view along line 24 of FIG. 23.
Figure 25:
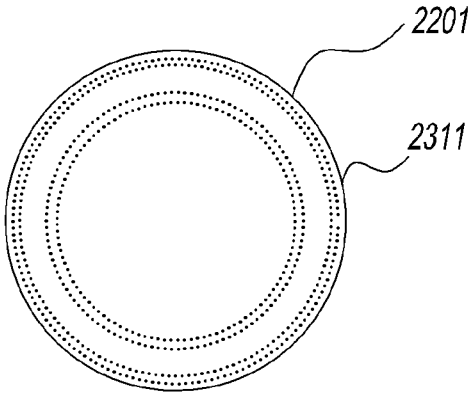
FIG. 25 is a top view of the insert device of FIG. 23.

Referring to FIGS. 23-25, active insert device 2201 comprises a sealing insert 2311, a backing 2313 and internal components 2203. Backing 2313, sealing insert 2311 and some of the internal components 2203 are bonded together along a top lip 2315 of sealing insert 2311 with a hermetically sealed bond 2316 that provides a complete hermetic seal along the circumference of active insert device 2201.

Figure 26:
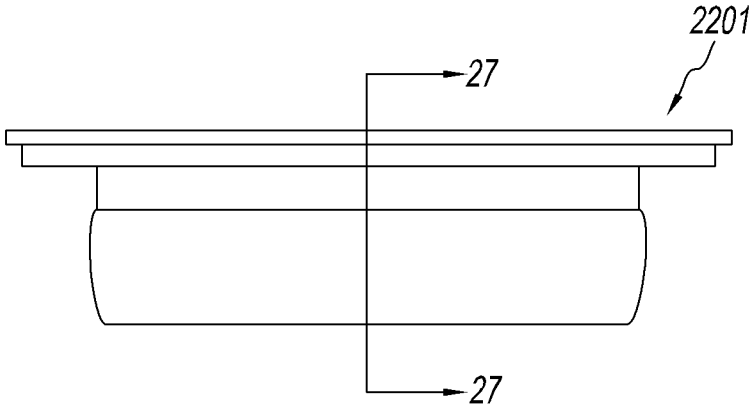
FIG. 26 is an enlarged side view of the active insert device of FIG. 23.
Figure 27:
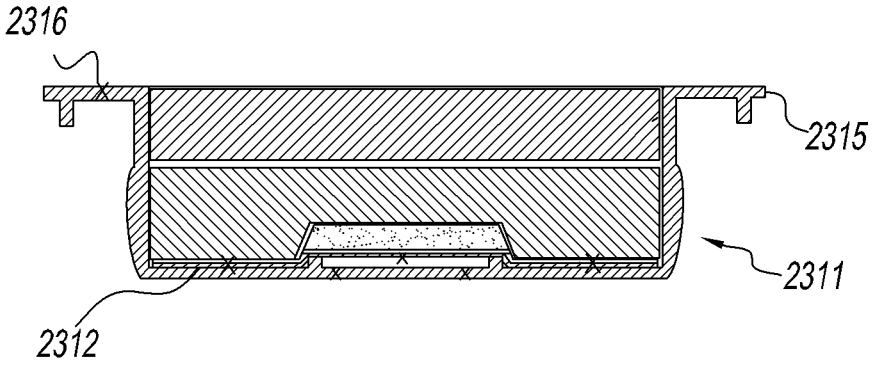
FIG. 27 is a cross-sectional view along line 27 of FIG. 26.
Figure 28:
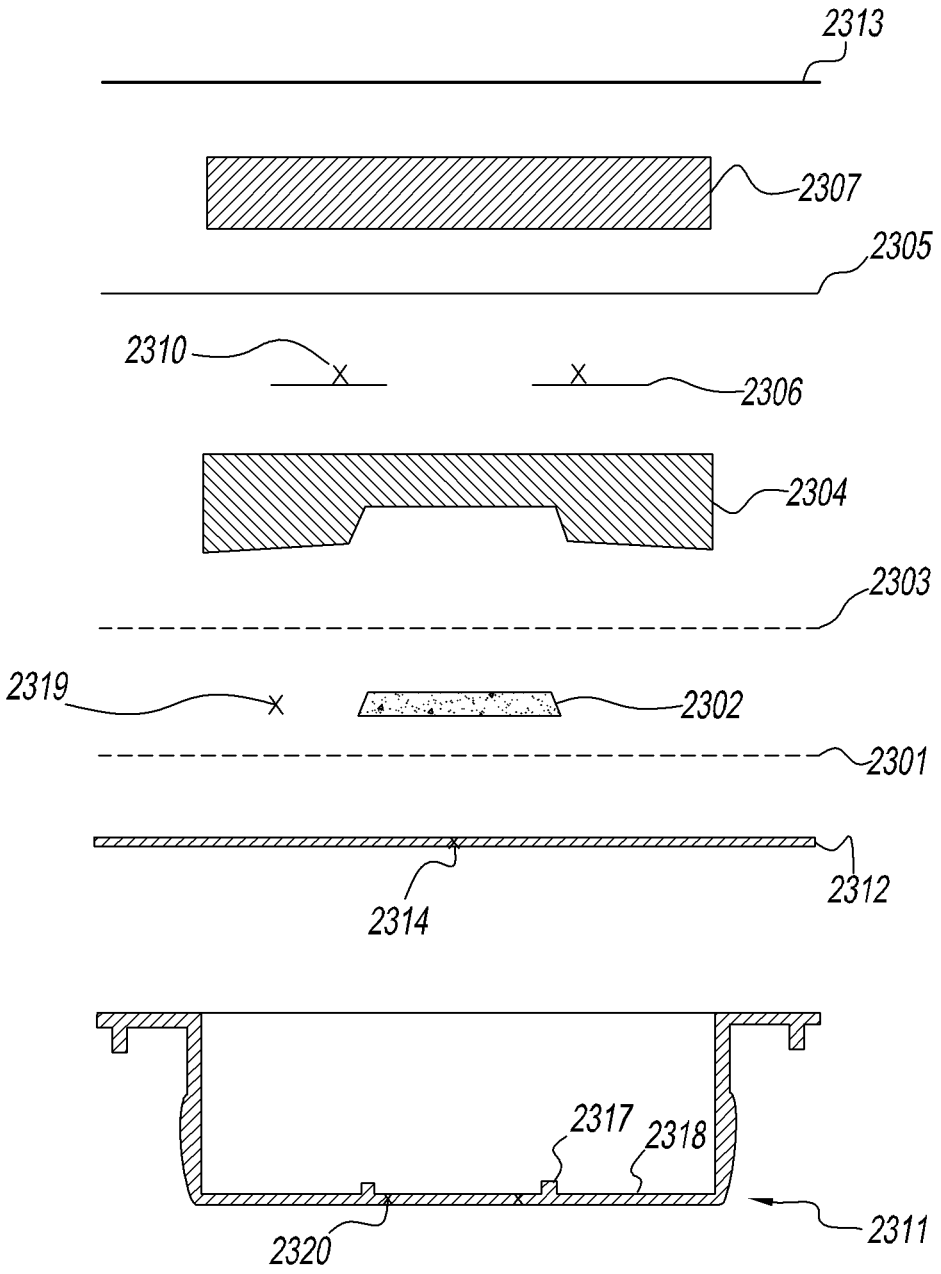
FIG. 28 is an exploded view of FIG. 27.

Referring to FIGS. 26-28, active insert device 2201 comprises backing 2313, a first reactant 2307, a metallic inductor 2306, a separator seal 2305, a second reactant 2304, a filter membrane 2303, a filter media 2302, a backing membrane 2301, a septum seal 2312 with score marks 2314 and sealing insert 2311 with vent ports 2320. Prior to assembly, separator seal 2305 and metallic inductor 2306 are bonded together using a suitable bond 2310, filter media 2302 is sandwiched between filter membrane 2303 and backing membrane 2301, which are bonded to one another with a suitable bond 2319. Upon assembly, septum seal 2312 and the sandwiched filter membrane 2303, filter media 2302 and backing membrane 2301 are stretched over an internal raised lip 2317 and bonded to an internal surface 2318 of sealing insert 2311 with a suitable bond 2321. Second reactant 2304, separator seal 2305 with metallic inductor 2306, first reactant 2307 and backing 2313 are inserted into sealing insert 2311 and secured by a hermetically sealed bond 2316 across the top lip 2315 of sealing insert 2311.

Figure 29:
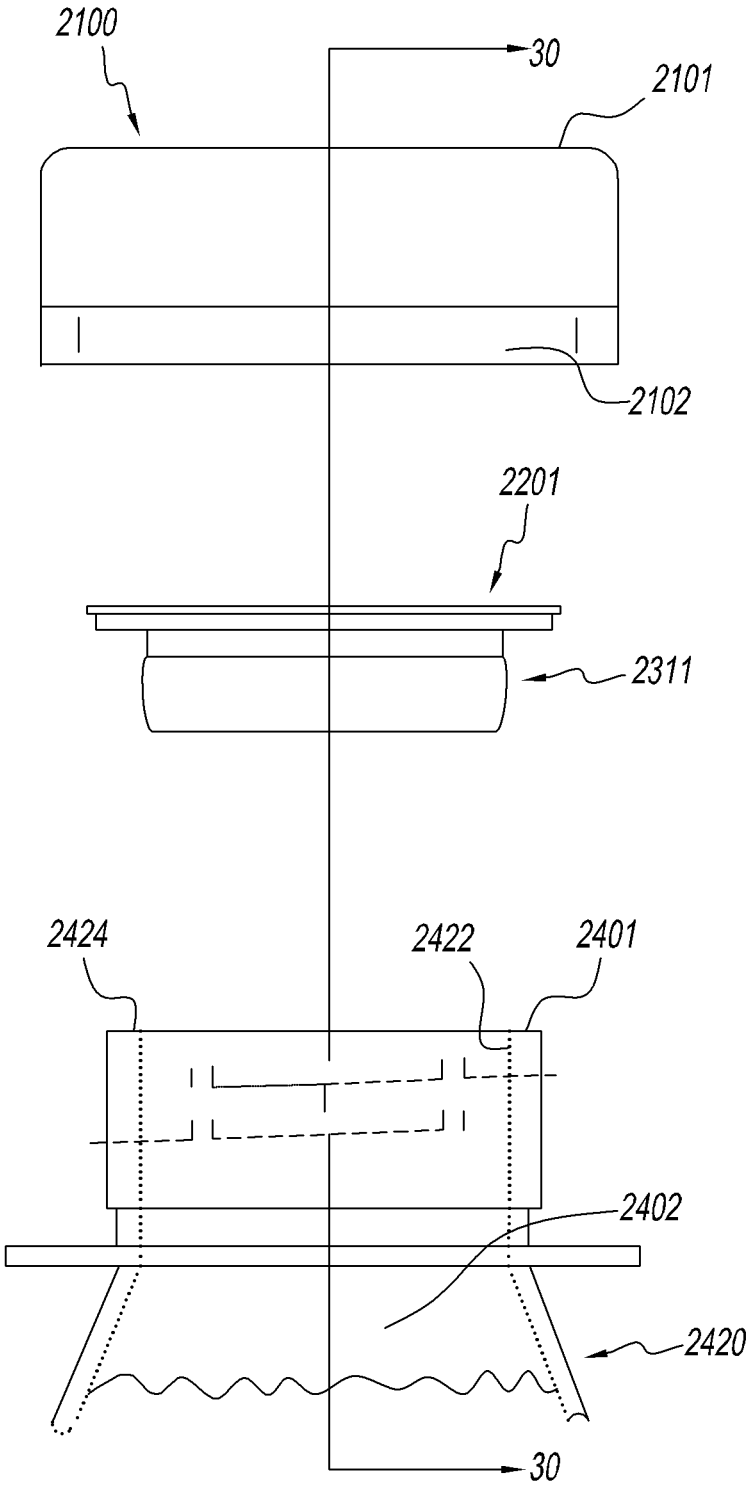
FIG. 29 is an exploded side view of a second embodiment of a device of the present disclosure with the active insert device of FIG. 23 positioned in the closure of FIG. 21.
Figure 30:
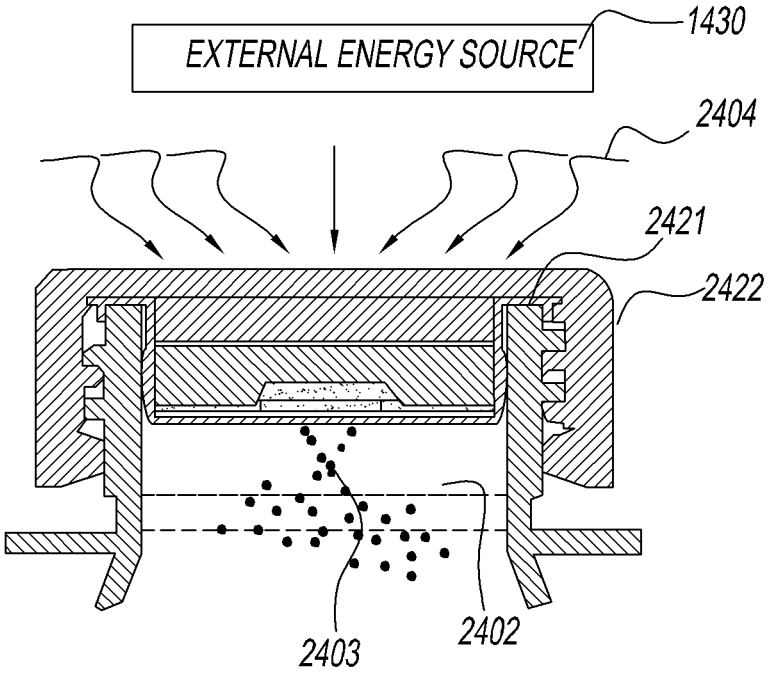
FIG. 30 is a cross-sectional view of FIG. 29 along line 30.

Referring to FIGS. 29 and 30, functional closure 2100 is mounted onto a container neck finish 2401 of a container 2420. Functional closure 2100 serves two functions. First, functional closure 2100 provides a hermetic seal to neck finish 2401 achieved through an internal lip 2421 of sealing insert 2311 contacting an internal surface 2422 of neck finish 2401 and through a landing surface 2423 (FIG. 24) contacting a landing 2424 of neck finish 2401. Second, functional closure 2100 provides a housing for active insert device 2201, which can be initiated actively in order to provide gas 2403 to container 2420 or a headspace 2402 while still maintaining the integrity of the hermetic seal on neck finish 2401.

While these arrangements are preferred embodiments, it is possible to conceive of other variations in design that provide the functions described above. In the first, second and third embodiments, the function of active insert device 201, 1201 or 2201 is to control the generation, purification and release of a gas 403, 1403 or 2403 into container headspace 402, 1402 or 2402 to hermetically inflate and or pressurize container 420, 1420 or 2420. In the first step of the process, functional container closure 100, 1100 or 2100 is screwed onto neck finish 401,1401 or 2401 of container 420, 1420 or 2420 with a suitable torque to create a hermetic seal between vent seal 309 and the neck finish 401 or between sealing insert 1311 or 2311 and neck finish 1401 or 1401.

Referring again to the first, second and third embodiments, in the second step of the process, metallic inductor 306, 1306 or 2306 is heated by means of a current flow induced in it through the application of external electromagnetic energy 404, 1404 or 2404 provided by an external energy source 430, 1430 and 2430 as shown in FIGS. 10, 20 and 30, respectively. The heated metallic inductor 306, 1306 or 2306, being in contact with separator seal 305, 1305 or 2305 through bond 310, 1310 or 2310, causes separator seal 305, 1305 or 2305 to be modified (for example, by shrinking, tearing or delaminating) thereby allowing first reactant 307, 1307 or 2307 and second reactant 304, 1304 or 2304 to come into contact and begin reacting with one another. This reaction generates gases, which are forced through filter membrane 303,1303 or 2303 and come into contact with filter medium 302, 1302 or 2302.

Filter medium 302, 1302 or 2302 is designed to capture, retain and or convert certain vapors and gases and prevent them from passing through the backing membrane 301, 1301 or 2301 while allowing the desired components including desired gases 403, 1403 or 2403 to pass through the backing membrane 301, 1301 or 2301.

Referring to the first embodiment, the desired gas 403 passes between backing membrane 301 and the internal surface 103 of cap 101 thereby creating a pressure point at one or more vent ports 202. The pressure of gas 403 trying to pass through one or more vent ports 202 causes vent seal 309 to release its bond to shroud 308 and separate in the area of vent port 202. The small separation allows gas 403 to pass into headspace 402. Gas 403 continues to pass through into headspace 402 until the pressure in headspace 402 equalizes with the pressure being generated inside the active insert device 201. At this point, vent seal 309 stretches back into its original position, closing the separation between itself and shroud 308 and again creating a hermetic seal that prevents a reverse flow through one or more vent ports 202.

Referring to the second embodiment, the desired gas 1403 passes through backing membrane 1301 and exits sealing insert 1311 through perforations 1315. The exiting gas 1403 from perforations 1315 creates a pocket behind septum seal 1312 thereby allowing score marks 1314 to open and allow gas 1403 to vent into headspace 1402. Once the pressure in the headspace 1402 equalizes with that inside sealing insert 1311, septum seal 1312 returns to its original state and the score marks close thereby sealing off headspace 1402 from insert device 1201.

Referring to the third embodiment, the desired gas 2403 passes through backing membrane 2301 and pushes down on septum seal 2312 thereby allowing score mark 2314 to open and allow gas 2403 to exit sealing insert 2311 through vent ports 2320 and vent into headspace 2402. Once the pressure in headspace 2402 equalizes with that inside sealing insert 2311, septum seal 2312 returns to its original state and score marks 2314 close thereby sealing off headspace 2402 from insert device 2201.

It will be apparent to those skilled in the art that many other embodiments may be conceived of that would result in the same outcome as those intended and contemplated within this disclosure. Therefore, without reference to any specific figure, the following should be noted. The first reactant 307, 1307 or 2307 and the second reactant 304, 1304 or 2304 can be made up of any substance or mixture of substances (in any phase, solid, liquid or vapor) that when coming into contact with one another causes a reaction to take place that produces a third product or products that are desirable for the specific function for which the functional closure device is designed.

In the inflation and or pressurization embodiment described above, the reactants are selected for a diazotization reaction. First reactant 307, 1307 or 2307 is a primary amine, which is defined as an ammonia molecule with one hydrogen substituted by any organic or inorganic compound, usually represented by R; for example, R—$NH_2$, where the primary amine can be selected from the following groups: normal alkyl amines ($CH_3(CH_2)_n$—$NH_2$, where $CH_3(CH_2)_n$— represents straight-chain, normal alkyl groups of any length), for example, n-propyl amine; aromatic amines (AR-$NH_2$, where AR represents any aromatic compound) for example aniline; amides (RCO—$NH_2$, where RCO— represents any acyl group) for example propylamide; salts of sulfamates ($XOSO_2$—$NH_2$, where X represents any cation), for example, sodium sulfamate, and O-substituted sulfamates ($ROSO_2$—$NH_2$, where R represents any organic compound), for example, o-propyl sulfamate.

Second reactant 304, 1304 or 2304 of the diazotization comprises a nitrite salt and a proton donor, or a nitrite ester and a proton donor. The nitrite salt can be selected from the group of the salts of nitrous acid, $XNO_2$ (where X represents any cation), for example, lithium nitrite, sodium nitrite, potassium nitrite, calcium nitrite, and barium nitrite. An example of a group of nitrite esters is the nitrite esters of alcohols. One example is ethyl nitrite ($CH_3CH_2ONO$), which is the nitrite ester of ethyl alcohol. The proton donor is any organic acid, for example, mono and dihydrogen citrates, citric, ascorbic, carboxylic and phenolic acids, or any non-organic acid, such as mineral acids, for example, hydrochloric, sulfuric and bisulfate.

When external energy 404, 1404 or 2404 is incident on active insert device 201, 1201 or 2201, a reaction of the nitrite salt and the proton donor forms nitrous acid and ultimately a nitrosonium ion ($NO^+$). The nitrosonium ion reacts with the primary amine to produce an unstable diazonium intermediate, which readily decomposes in nitrogen gas. In this preferred embodiment, first reactant 307, 1307 or 2307 is preferably sodium sulfamate and second reactant 304, 1304 or 2304 is preferably sodium nitrite and di-sodium citrate. Other substances in the reactants may include but are not limited to catalysts, filers, binders, surfactants and antifoaming agents that do not participate directly in the reaction but provide other functionality such as catalyzing, enhancing and controlling the rate of reaction and or retaining certain reactant mixtures and reaction products.

Filter membrane 303, 1303 or 2303, filter media 302, 1302 or 2302 and backing membrane 301, 1301 or 2301 together form a filter system designed to capture, retain or filter out any undesirable reaction products. Filter media 302, 1302 or 2302 can be any substance or mixture of substances designed for the adsorption, absorption, oxidation, reduction or other reaction, retention and/or alteration of the characteristics of any specific reaction products or byproducts for which the functional closure device is designed. In the inflation and or pressurization embodiment described above, the filter media contains for example a suitable mixture of permanganate, hydroxide, and activated carbon so that any carbon dioxide, oxides of nitrogen, formaldehyde, acid gases, amines, ammonia, chlorine, nitrates, nitrites and hydrocarbons are converted and retained within the filter system while allowing pure nitrogen gas to pass through into the headspace 402, 1402 or 2402.

An example of a suitable filter media is a mixture of >50% potassium permanganate, <30% Calcium Hydroxide, <20% Activated Carbon, and <2% Sodium Hydroxide, the remainder being made up of fillers and or binders such as Silicon Dioxide $SiO_2$. Other substances in the filter media include but are not limited to filers, binders, activators and catalysts that do not necessarily participate in the filtration process but provide other functionality to the filter system such as, for example, controlling the rate of flow and dispersion of the reaction products and or surface area, concentration and texture of the filter media.

Filter membrane 303, 1303 or 2303 and backing membrane 301, 1301 or 2301 can be any material or composition of materials that provide a controlled porosity layer suitable for the function of allowing certain products or mixtures of products to pass through while retaining or preventing other products or mixtures of products from passing through.

Bond 204 is any suitable bond along the perimeter that joins backing membrane 301, filter membrane 303, separating seal 305 and shroud 308 together. Bond 204 can be formed using adhesives, heat welding or any other hot or cold process that achieves the desired hermetic seal. Bond 310, 1310 or 2310 is any suitable bond between separator seal 305, 1305 or 2305 and metallic inductor 306, 1306 or 2306 that ensures heat transfer between the materials that further allows the separator seal to tear, rupture, delaminate or become cut in a controllable manner.

The securing of active insert device 201 into closure 101 along the perimeter of internal surface 103 can be achieved with any suitable bond that provides a hermetic seal along said perimeter without blocking access to one or more vent ports 202. The bond secures active insert device 201 in such a way that it becomes a single unit with cap 101 and remains in place when cap 101 is removed from neck finish 401. The bond is intended to be achieved such that active insert device 201 cannot be removed non-destructively from the cap 101. This bond can be formed using adhesive or heat welding or any other suitable hot or cold bonding process.

Vent seal 309 can be any material or combination of materials that allow it to become hermetically bonded to the external surface of shroud 308 while still allowing the bond to separate in the area of one or more vent ports 202. This causes vent seal 309 to stretch away from shroud 308 in this area further allowing vent ports 202 to become open under pressure. Upon equalization of pressure between active insert device 201 and headspace 402, vent seal 309 is allowed to flex back over the vent ports 202, thereby closing them and preventing any back flow from the headspace 402 into the active insert device 201. Vent seal 309 also forms a hermetic seal between active insert device 201 and neck finish 401 thereby containing the headspace gases 403 and allowing headspace 402 to become inflated and maintain a positive pressure. In the embodiment described above, vent seal 309 has the property of elasticity and may be constructed from materials selected from the group of saturated and unsaturated rubbers, elastomers and self healing elastomers.

Septum seal 1312 or 2312 can be any material or combination of materials that allow it to act as a septum and allows for score marks to open and close at varying pressure differentials. In the second embodiment described above, the septum seal has the property of elasticity and may be constructed from materials selected from the group of saturated and unsaturated rubbers, elastomers and self healing elastomers.

Bond 1316 or 2316 may be any suitable bond that forms a hermetic seal between the device layers and the sealing insert 1311 or 2311. Bond 1316 or 2316 can be formed using adhesives, heat welding or any other hot or cold process that achieves the desired hermetic seal. Bond 1318 or 2321 is any suitable bond that bonds septum seal 1312 or 2312 to sealing insert 1311 or 2311 and allows it to stretch away and return to its original state. Bond 1318 or 2321 can be formed using adhesives, heat welding or any other hot or cold process that achieves the desired seal.

Internal lip 1421 or 2421 is any lip that creates a seal when contacted with internal surface 1422 or 2422 and can be of any shape, texture or profile that best achieves that outcome. Landing surface 1423 or 2423 is any surface that creates a seal when contacted with landing 1424 or 2424 and can be any shape, texture or profile to achieve that outcome.

The present disclosure having been thus described with particular reference to the preferred forms thereof, it will be obvious that various changes and modifications may be made therein without departing from the spirit and scope of the present disclosure as defined in the appended claims.

What is claimed is:

1. A method for delivering a gas to a container that includes a closure that hermetically seals and closes said container, said method comprising:

disposing an active insert device into said container, wherein said active insert device comprises one or more reactants, wherein one of said reactants comprises a primary amine selected from the group consisting of: sodium sulfamate, n-propyl amine, anilene, propylamide, and o-propyl sulfamate;

initiating said reactants into a diazotization reaction to produce a gas within said active insert device; and delivering said gas to a headspace of said container, thereby increasing a pressure of said headspace of said container.

2. The method of claim 1, wherein said primary amine is from the group of R—$NH_2$, where R is selected from the group consisting of: normal alkyl amines, aromatic amines, amides, and salts of sulfamates.

3. The method of claim 1, wherein a second of said reactants comprises a proton donor and either a nitrite salt or a nitrite ester.

4. The method of claim 3, wherein said nitrite salt is selected from the group of the salts of nitrous acid, consisting of: lithium nitrite, sodium nitrite, potassium nitrite, calcium nitrite, and barium nitrite, and wherein said nitrite ester is selected from a group consisting of: nitrite esters of alcohols.

5. The method of claim 3, wherein said proton donor is any organic acid or any non-organic acid.

6. The method of claim 5, wherein said organic acid is selected from the group consisting of: mono and dihydrogen citrates, citric, ascorbic, carboxylic and phenolic acids, and wherein said non-organic acid is selected from the group consisting of: hydrochloric, sulfuric and bisulfate.

7. The method of claim 1, wherein said diazotization reaction is initiated in response to energy provided by an external energy source.

8. The method of claim 7, wherein said energy creates contact between the reactants and initiates said diazotization reaction.

9. The method of claim 7, wherein said active insert device further comprises a heat producing element in thermal transfer relationship to said reactant, and wherein said source of energy provides electromagnetic energy that induces an electrical current in said heat producing element so as to thermally initiate said diazotization reaction.

10. The method of claim 1, wherein said active insert device is disposed on said closure, and wherein said disposing step comprises fastening said closure to said container.

11. The method of claim 1, further comprising:

filtering said gas before delivery to said headspace of said container.

12. The method of claim 11, wherein said gas is nitrogen, and wherein said filtering step uses a filter material that retains reaction products of said reaction while allowing said nitrogen gas to be delivered to said headspace of said container.

13. The method of claim 12, wherein said filter material contains a mixture of permanganate, hydroxide and activated carbon that allows nitrogen gas to be delivered to said headspace of said container while retaining any carbon dioxide, oxides of nitrogen, formaldehyde, acid gases, amines, chlorine, cyanide, nitrates, nitrites and hydrocarbons of said reaction.

14. The method of claim 1, wherein said gas is delivered to said headspace of said container via at least one vent port, further comprising; closing said vent port when a pressure on the active insert device side of said vent port equalizes with a pressure of said headspace of said container so as to prevent back flow.

* * * * *